US006570602B1

(12) United States Patent
Miller

(10) Patent No.: US 6,570,602 B1
(45) Date of Patent: May 27, 2003

(54) GENERATING AND STORING SUPPLY SPECIFIC PRINTING PARAMETERS

(75) Inventor: John R. Miller, Richfield, MN (US)

(73) Assignee: Brady Worldwide, Inc., Milwaukee, IL (US)

( * ) Notice: Subject to any disclaimer, the term of this patent is extended or adjusted under 35 U.S.C. 154(b) by 0 days.

(21) Appl. No.: 09/683,719

(22) Filed: Feb. 6, 2002

(51) Int. Cl.[7] ..... B41J 2/36
(52) U.S. Cl. ..... 347/188; 347/214
(58) Field of Search ..... 347/188, 214, 347/195, 19; 400/207, 208, 208.1, 120.09, 120.15

(56) References Cited

U.S. PATENT DOCUMENTS

| | | | | |
|---|---|---|---|---|
| 4,567,488 A | | 1/1986 | Moriguchi et al. | 346/76 |
| 5,455,617 A | * | 10/1995 | Stephenson et al. | 347/214 |
| 5,548,688 A | | 8/1996 | Wiklof et al. | 395/108 |
| 5,559,547 A | | 9/1996 | Hagar | 347/211 |
| 5,610,635 A | * | 3/1997 | Murray et al. | 347/77 |
| 5,625,399 A | | 4/1997 | Wiklof et al. | 347/195 |
| 5,793,403 A | | 8/1998 | Klinefelter | 347/195 |
| 6,008,831 A | | 12/1999 | Nakanishi et al. | 347/195 |
| 6,034,705 A | | 3/2000 | Tolle et al. | 347/195 |
| 6,219,153 B1 | | 4/2001 | Kawanabe et al. | 358/1.16 |
| 6,249,299 B1 | | 6/2001 | Tainer | 347/191 |

FOREIGN PATENT DOCUMENTS

| | | | |
|---|---|---|---|
| JP | 61116555 | 6/1986 | B41J/3/20 |
| JP | 4305471 | 10/1992 | B41J/2/36 |

* cited by examiner

*Primary Examiner*—Huan Tran
(74) *Attorney, Agent, or Firm*—Whyte Hirschboeck Dudek SC

(57) ABSTRACT

A method of determining supply parameters and storing the supply parameters in a memory is disclosed. The method comprises: providing supply characteristics for a supply, selecting a dot history pattern, generating a table, the table comprising values based on the selected dot history pattern and the provided supply characteristics, and storing supply parameters, based on the values in the generated table, in a memory associated with the supply. Thereafter, the stored supply parameters can be accessed, either before or during printing, to regulate the energy delivered to thermal elements, to increase printing speed, and to reduce the workload of the processor in the system.

41 Claims, 6 Drawing Sheets

36 36

MICROSTROBE ENERGY VALUES

| S1 | S2 | S3 | S4 | S5 |
|---|---|---|---|---|
| 1,000 | 5,000 | 5,000 | 4,000 | 19,000 |

54 54

FIG. 8

30 36 36

MICROSTROBES

| INDEX | S1 | S2 | S3 | S4 | S5 | STROBE NUMBER |
|---|---|---|---|---|---|---|
| 0 | 1 | 1 | 1 | 1 | 1 | 31 |
| 1 | 0 | 1 | 1 | 1 | 1 | 30 |
| 2 | 0 | 1 | 1 | 1 | 1 | 30 |
| 3 | 0 | 0 | 1 | 1 | 1 | 28 |
| 4 | 0 | 1 | 1 | 1 | 1 | 30 |
| 5 | 0 | 0 | 1 | 1 | 1 | 28 |
| 6 | 0 | 0 | 1 | 1 | 1 | 30 |
| 7 | 0 | 0 | 1 | 1 | 1 | 28 |
| 8 | 1 | 1 | 1 | 1 | 1 | 31 |
| 9 | 0 | 1 | 1 | 1 | 1 | 30 |
| 10 | 0 | 1 | 1 | 1 | 1 | 30 |
| 11 | 0 | 0 | 1 | 1 | 1 | 28 |
| 12 | 0 | 0 | 1 | 1 | 1 | 28 |
| 13 | 0 | 0 | 0 | 1 | 1 | 24 |
| 14 | 0 | 0 | 0 | 1 | 1 | 24 |
| 15 | 0 | 0 | 0 | 0 | 1 | 16 |

32 34 34 38 38 56 56

FIG. 9

GENERATING AND STORING SUPPLY SPECIFIC PRINTING PARAMETERS

FIELD OF THE INVENTION

The present invention relates generally to methods of generating look-up tables for a specific supply based on dot history. In one aspect, the invention relates to methods of generating look-up tables for a specific supply in a thermal printing process based on dot history and storing the look-up tables for use with the specific supply.

BACKGROUND OF THE INVENTION

A typical thermal printer includes a printhead comprising a linear array of thermal elements. The number of thermal elements in the linear array can vary, with a characteristic printhead employing 1248 thermal elements. Each of the thermal elements produces heat in response to energy supplied by a microcontroller associated with the thermal printer. The microcontroller applies a voltage or current to each of the thermal elements to heat the thermal elements to a level sufficient to transfer dots (i.e., burns, printed dots, etc.) onto a media (e.g., an adhesive-backed substrate with an opposing ink-receiving surface). This is accomplished when a thermally-sensitive supply (e.g., ink-bearing ribbon, donor ribbon, etc.) comes into thermal contact with the thermal elements while proximate the media. Each thermal element can transfer a dot, or leave an unprinted area, depending on the amount of energy supplied to the thermal element.

Color printing is made possible by using a colored thermally-sensitive supply (e.g., a supply that contains colored ink). When the thermal element comes into thermal contact with the colored supply, a colored dot is generated. The range of colors available to the printer can be expanded if an additional, differently colored dot is generated upon a first colored dot, such that the two colored dots combine to make a third color. This process of laying one dot over another can be repeated to produce a myriad of colors and/or shades of color.

As thermal elements in the linear array are selectively, intermittently fired, a raster line of dots and/or unprinted areas is produced. The media is stepped past the array of thermal elements in a direction transverse to an array of thermal elements such that consecutive raster lines are produced on the media. The raster line most recently printed is known as the current raster line, the raster line printed one generation earlier is known as the previous raster line, and the raster line printed two generations earlier is known as the two-back raster line. The patterns of dots produced within each raster line are known as burn patterns. These burn patterns can comprise all, or a portion of, the dots in the raster line. Thus, the current raster line produces current burn patterns, the previous raster line produces previous burn patterns, and so on, through the burn pattern generations to create a history of burn patterns within the raster lines (history is referred to in greater detail below).

While the temperature of a thermal element can be quickly raised by the application of energy, a longer time is required for the thermal element to cool, generally along an exponential curve that is affected by the ambient temperature of the printhead. This result occurs because a thermal element will retain heat and/or receive heat radiated from adjacent thermal elements. Thus, the thermal element will remain hot long after energy is directed to that thermal element. One problem with the thermal element remaining hot arises when the thermal element is instructed to remain idle (i.e., insufficiently heated), meaning that an area on the media remains unprinted. If the thermal element is too hot, a dot, or portion thereof, may be generated where no dot is desired.

The dilemma of excess retained or radiated heat predominately occurs after a series of consecutive dots are generated. For example, where a series of dots are produced by a thermal element at four consecutive sites on a media, and then the thermal element is instructed to remain idle at a fifth site, a dot might nonetheless be printed at the fifth site. This can occur if too much heat was retained by the thermal element after generating the first four dots because the thermal element remains above the temperature required to generate a dot when the thermal element reached the fifth site. In other words, the thermal element did not have sufficient time to cool below the temperature required to transfer a dot. Unfortunately, the normal consequence of the above example is a series of four dots followed by a fractional dot where there should be a blank, clear, or unprinted area. This problem is sometimes referred to in the art as hysteresis. Complicating the problem of hysteresis is the increasing printing speed being employed in printers. As the speed of printing increases, the media travels past the printhead faster and thermal elements have less time to cool.

Several approaches have been suggested to combat the problem of hysteresis. One such approach provides a plurality of thermal energy pulses of varying duration depending on whether a thermal element is "cold", "warm" or "hot". Another solution that has been suggested requires that all thermal elements be kept at an elevated resting temperature just below that needed for printing by supplying "maintenance" pulses during every interval that a thermal element is not actually printing. Yet, another solution to the problem employs dot history which takes into account the history of thermal element burn patterns in order to print more efficiently. In the simplest terms, dot history takes into account the firing, over time, of a thermal element and/or an adjacent thermal element or elements. Unfortunately, undertaking any of the above methods requires onerous calculations to be performed by the processor in the printer system. Part of the problem stems from the fact that each specific supply used in the printing system possesses different characteristics (e.g., width, ink color, ink type, etc.) that must be considered to produce a quality print. Thus, a printer processor is required to make numerous calculations, usually during the printing operation, for each new supply used.

In U.S. Pat. No. 6,034,705 to Tolle, et. al., and again in U.S. Pat. No. 6,249,299 to Tainer, methods of controlling energy supplied to a single thermal element based on dot history are disclosed. Also, In U.S. Pat. No. 5,548,688 to Wiklof, et. al., another method of controlling the energy supplied to a single thermal element based on dot history and adjacent thermal elements is disclosed. Wiklof also discloses determining the printing activity, namely whether the thermal element is energized or not energized for each segment in the scan line time, for a single thermal element and storing the information in a look-up table. However, the methods of Tolle, Tainer, and Wiklof, command a large processor memory and consume a vast amount of processor time, and as such, these methodologies become less desirable, particularly as more thermal elements and/or adjacent thermal elements in dot history are taken into consideration. Moreover, the above methods tend to monopolize and over-tax the processor in a printing system. Thus, a more efficient method of printing employing look-up tables is needed. Further, a more desirable location for storing the look-up tables would be preferred.

SUMMARY OF THE INVENTION

A method of determining supply parameters and storing the supply parameters in a memory. In one embodiment, the method comprises providing supply characteristics for a supply, selecting a dot history pattern, generating a table, and storing supply parameters based on the values in the generated table in a memory associated with the supply. In a preferred embodiment, the table comprises values based on the selected dot history pattern and the provided supply characteristics. The supply characteristics, which can be obtained from a supply cartridge containing a thermally sensitive, ink-bearing ribbon, can include supply width, supply length, supply thickness, and ink color. The method can employ a dot history pattern that comprises adjacent thermal elements and prior generations of thermal elements.

In one embodiment, the table is at least partially based on a thermal element number and a number of possible energy value combinations. A formula for providing the table with index values can comprise a sum of a left adjacent thermal element, a first product of two and a right adjacent thermal element, a second product of four and a previous generation of a selected thermal element, and a third product of eight and a two-back generation of the selected thermal element, wherein each of the thermal elements is represented by binary numbers. The index values are generally arranged sequentially from smallest to largest within the index.

The table can comprise a microstrobe number that represents one or more microstrobes. The microstrobes can receive a pulse of energy about two hundred microseconds apart in a print interval. The microstrobe number can be determined by testing the specific supply. The table can further comprise binary pulse numbers comprising a one, which corresponds to a microstrobe receiving a pulse of energy, or a zero, which corresponds to the microstrobe not receiving the pulse of energy. At least one of the microstrobes receives a pulse of energy that is sufficient to generate a dot, and typically, that microstrobe occurs last in the print interval. The table can also comprise a strobe number.

The memory can comprise a memory cell secured to a cartridge containing the supply. The memory comprise a solid-state memory device, a RAM, a non-volatile RAM, an EEPROM, and a flash memory.

In preferred embodiments, the method can comprise determining printing parameters and storing the printing parameters in a memory. In these embodiments, the method comprises providing supply characteristics for a supply, selecting a dot history pattern, and determining a thermal element number. Thereafter, an index having an index length can be created. The index length can be based on the thermal element number. Index values can be determined to occupy the index length. The index values can be based on the dot history pattern. A microstrobe number based on the supply characteristics can then be selected. The microstrobe number represents microstrobes within a print interval.

Thereafter, binary pulse numbers can be assigned to the each of the microstrobes based on a strobe pattern. The binary pulse numbers can correspond to each of the index values occupying the index length. For each of the microstrobes, a microstrobe energy value can be determined based on the supply characteristics. Strobe numbers can thereafter be determined based on the binary pulse numbers. The strobe numbers can correspond to each of the index values occupying the index length. The supply parameters, which include the microstrobe number, the microstrobe energy values, and the strobe numbers, can be stored in the memory associated with the supply.

The method can also comprise accessing the supply parameters using the processor. The accessed supply parameters can then be used to increase printing speed and regulated energy provided to thermal elements. This can assist in generating dots such that the dots are not malformed, fractional, unaesthetic, and otherwise undesirably generated.

Another aspect of the invention comprises a printing system for thermal printing. The system can comprise a printhead that contains thermal elements for generating dots, a processor for processing supply parameters, and a microcontroller for receiving signals from the processor. The microcontroller can orchestrate the thermal elements in the printhead such that an image of dots can be generated. The system can also include a supply cartridge, containing a thermally sensitive supply, and a memory secured to the supply cartridge. To be used, the supply cartridge is inserted within the printing system. In these aspects, supply characteristics can be provided for a supply, a dot history pattern can be selected, and a table can also be generated. The table can comprise values based on the selected dot history pattern and the provided supply characteristics. Supply parameters, based on the values in the generated table, can be stored in a memory associated with the supply.

A further aspect of the invention comprises an apparatus for use in a printer. The apparatus can comprise a supply container, a memory cell associated with the supply container, and supply specific printing parameters stored within the memory cell. In these aspects, the printer is configured to receive the supply container and a processor associated with the printer can obtain access to the supply specific printing parameters when the supply container is received.

In some embodiments, the memory cell can be erased after a supply stored within the supply container is exhausted. Further, the memory cell can contain an electronic lock capable of being unlocked by an electronic key associated with the printer. In these embodiments, the electronic key can be accessed by the printer and used to unlock the supply specific printing parameters stored in the memory cell.

BRIEF DESCRIPTION OF DRAWINGS

Embodiments of the invention are described below with reference to the accompanying drawings and are for illustrative purposes only. The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for the purpose of description and illustration and should not be regarded as limiting. Like reference numerals are used to indicate like components.

FIG. 8 illustrates, in one embodiment of the invention, microstrobe energy values assigned to each of the microstrobes in the partially completed organizational table of FIG. 6.

FIG. 9 illustrates, in one embodiment of the invention, the partially completed organizational table of FIG. 7 after strobe numbers have been calculated and inserted, thus completing the organizational table.

DETAILED DESCRIPTION OF THE PREFERRED EMBODIMENT

Figure 1:
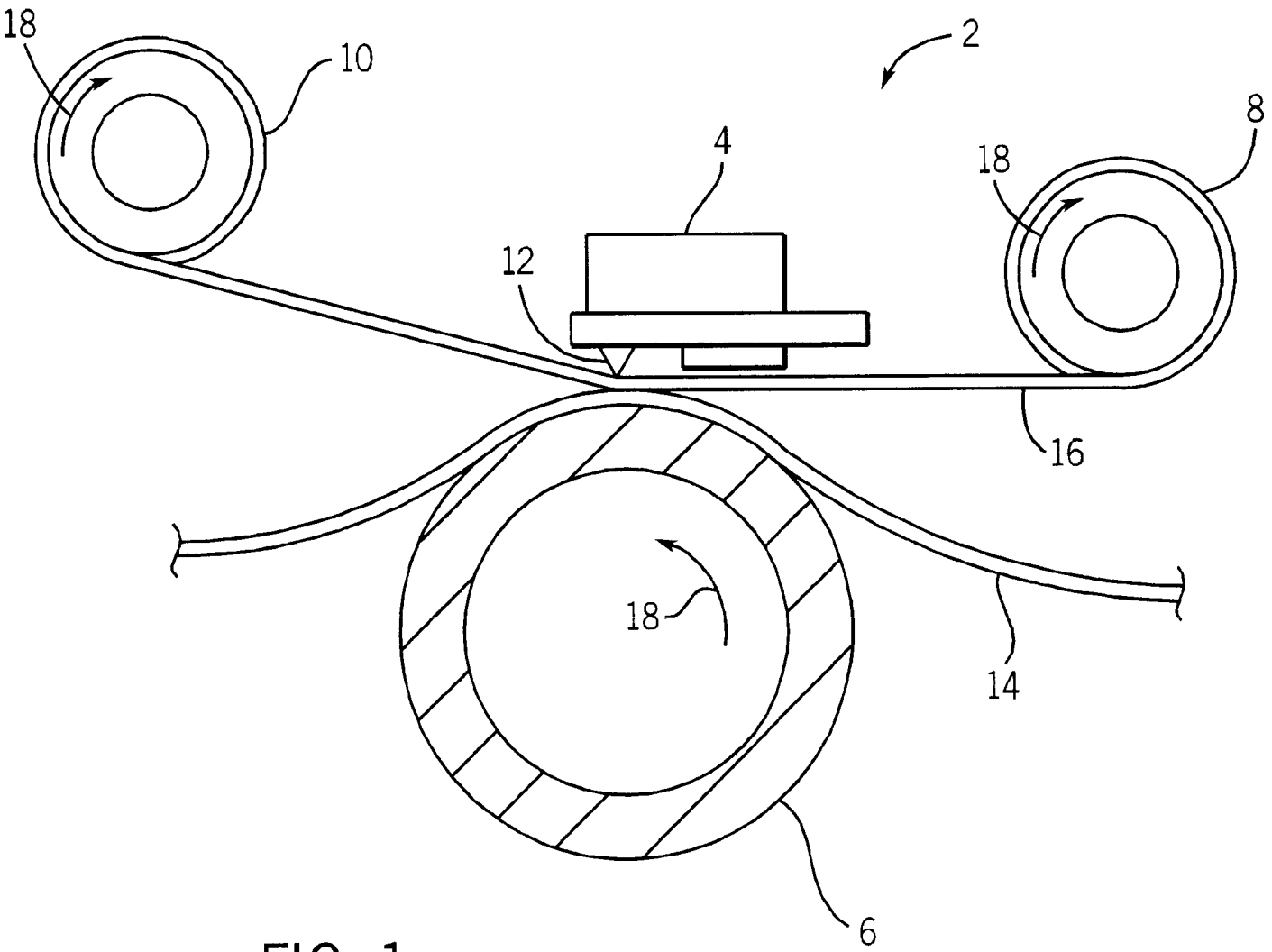
FIG. 1 illustrates an embodiment of a printing process in one aspect of the invention.

Referring to FIG. 1, a typical thermal printing arrangement 2 is illustrated. The printing arrangement 2 comprises a printhead 4, a platen roller 6, a supply delivery roller 8, and a supply take-up roller 10.

Figure 3:
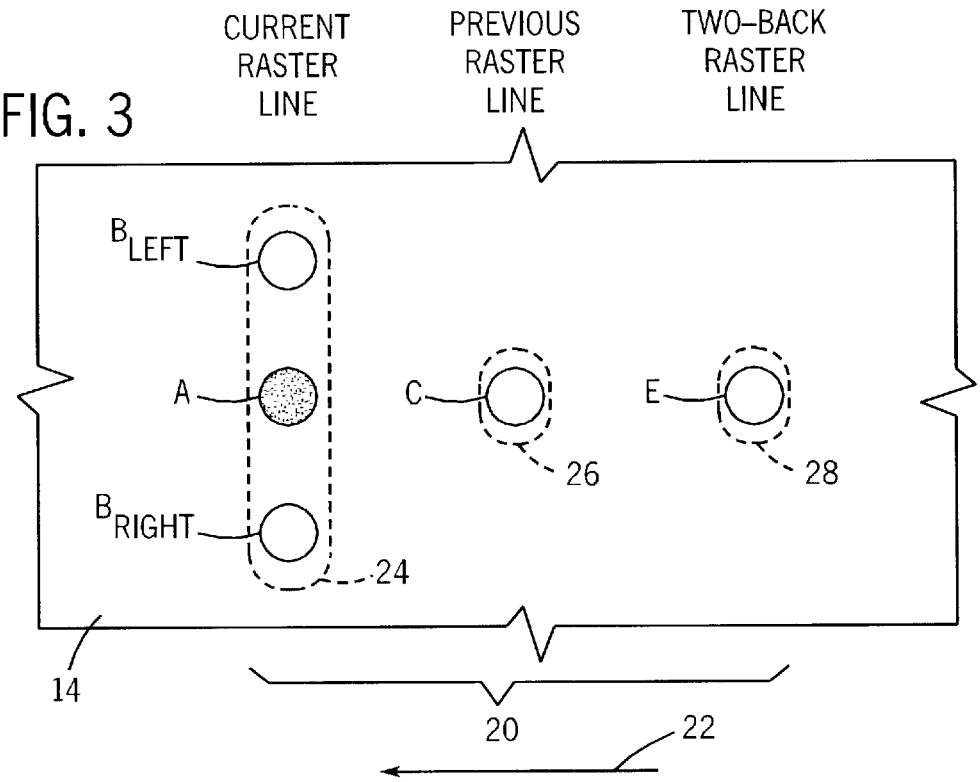
FIG. 3 illustrates an example of a dot history pattern, generated on a media, which can be used in one embodiment of the invention in FIG. 2.

A printhead 4 is typically equipped with a linear array of thermal elements 12. The number of thermal elements in the linear array can vary, with a characteristic printhead 4 employing one thousand two hundred forty-eight (1,248) thermal elements 12. Each thermal element 12 produces heat in response to energy supplied by a microcontroller (not shown) associated with printhead 4. The microcontroller applies a voltage or current to each thermal element 12 to heat the thermal elements to a level sufficient to transfer dots. The dots form at sites (e.g., A, $B_{left}$, $B_{right}$, C, E, as illustrated in FIG. 3) on a media 14. This is accomplished when a thermally-sensitive supply 16 comes into thermal contact with the thermal elements 12 while proximate media 14 as illustrated in FIG. 1. Directional arrows 18 in FIG. 1 indicate direction of travel of the various components in printing arrangement 2.

Figure 2:
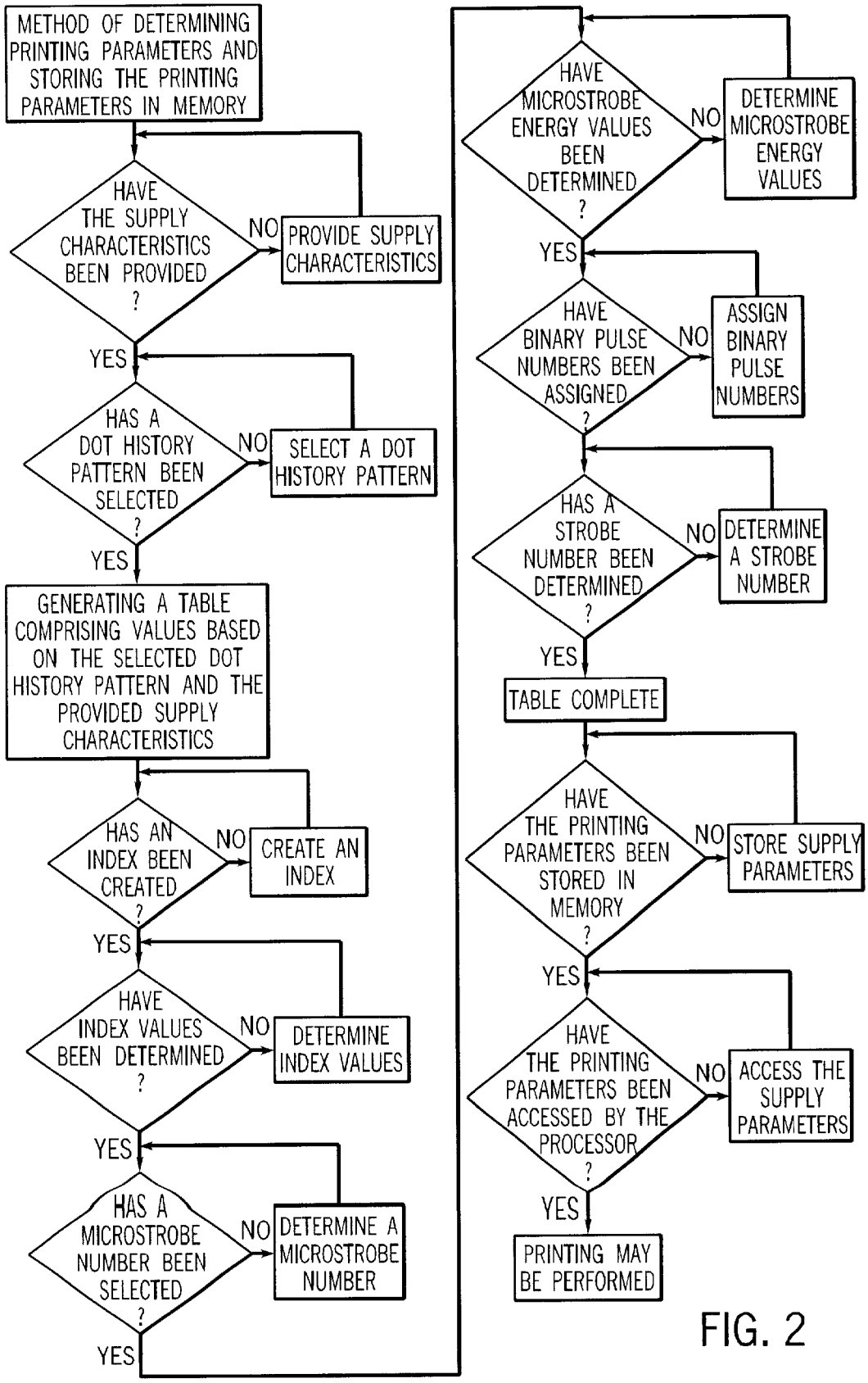
FIG. 2 illustrates a flow chart of the steps employed in one embodiment of the invention using the printing process of FIG. 1.

As illustrated in FIG. 2, a method of determining the amount of energy to be delivered to thermal element 12 for specific supply 16 employing dot history, and storing that amount in memory, is depicted. Thermal elements 12 require energy to produce a dot and, therefore, the method of FIG. 2 can be used with those thermal elements that are fired, wherein firing is defined as generating a dot, producing a burn, making a printed dot, etc., during printing, for example, using printing arrangement 2 of FIG. 1.

As shown in FIG. 2, the first step in one embodiment of the invention involves providing supply characteristics. Supply 16 is defined as that material that holds the ink, pigment, or other color-providing substance or material transferred to a media 14. As such, examples of supply characteristics can include supply width, supply length, supply thickness, ink color, and other like characteristics. Supply 16 can comprise donor ribbon or other thermally-sensitive materials for use in printing. Media 14 can comprise any substrate that accepts ink or pigment transferred from supply 16. As one example, media can comprise an adhesive-backed roll of material with an opposing dye-accepting surface. For each specific supply 16 available to a printer, supply characteristics can be ascertained and provided.

Referring to FIG. 3, after the specific supply characteristics have been provided, a dot history pattern 20 is selected. A dot history pattern 20 is that pattern of printed dots and/or unprinted dot sites (e.g., A, $B_{left}$, $B_{right}$, C, and E) that result when thermal elements 12(FIG. 1) fire or do not fire. A dot can be generated (FIG. 1) on the media 14 when a thermal element 12 proximate that site is fired. For example, in FIG. 3, a dot is generated at site A on the media 14 when a thermal element 12 (FIG. 1) proximate site A is heated to a level sufficient to transfer ink from the supply 16 to the media 14. If the thermal element is not sufficiently heated, no dot will be generated and the site will remain blank or unprinted.

Figure 4:
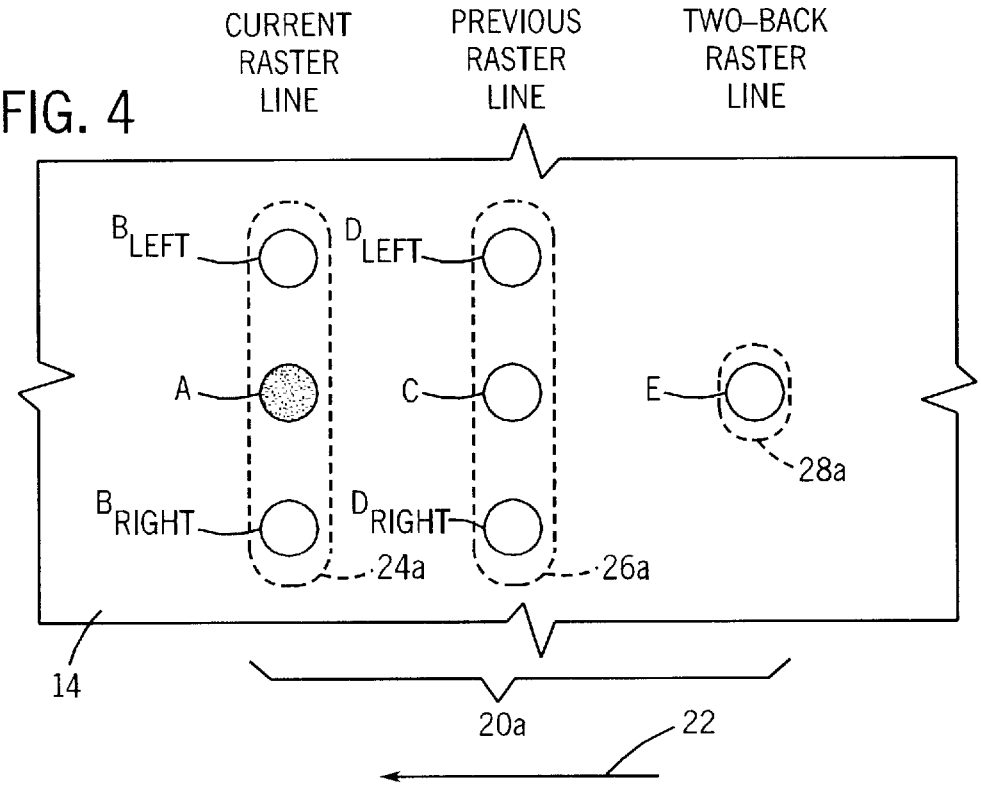
FIG. 4 illustrates a further example of a dot history pattern, generated on a media, which can be used in one embodiment of the invention of FIG. 2.

Throughout the description, examples using FIGS. 3 and 4 are utilized to assist in the explanation of the invention. In each example and elsewhere, the thermal element proximate site A, which is capable of producing a dot at site A, will be referred to as the selected thermal element. Such selected thermal element will serve as a reference point in the examples.

Dots at sites $B_{left}$ and $B_{right}$ are also generated on a media 14 when thermal elements 12 proximate sites $B_{left}$ and $B_{right}$, respectively, are heated to a level sufficient to transfer pigment from supply 16 to media 14. Again, if sufficient heating fails to be accomplished, no dot will be generated. Sites $B_{left}$ and $B_{right}$ are those sites immediately adjacent the selected thermal element in the current raster line as illustrated in FIGS. 3 and 4.

Sites C and E are defined somewhat differently. In FIG. 3, for example, a dot at site C is a dot that has been produced by the selected thermal element proximate site A except that the dot has now been shifted one generation. In other words, site C, which is located in the previous raster line, is the old dot from site A. The shift of the dot (or lack of a dot) from site A to site C occurs as media 14 advances during printing relative to the direction of printing arrow 22. Likewise, a dot at site E is a dot that has been produced by the selected thermal element proximate site A except that the dot has now been shifted two generations. In other words, site E, which is located in the two-back raster line, is the old dot from site C and the even older dot from site A. Here again, the shift of the dot (or lack of a dot) from site A, to site C, to site E occurs as media 14 advances during printing relative to the direction of printing arrow 22.

Referring to FIGS. 3 and 4, two examples of dot history patterns that can be used in the invention are illustrated. In addition to those dot history patterns illustrated, a variety of other patterns may be employed in the invention. For clarity, a general explanation of a dot history pattern using FIG. 3 as an example will be provided to assist the reader in understanding the invention. Referring to FIG. 3, dot history takes into account burn patterns 24, 26, 28, of thermal elements over several consecutively-fired raster lines. As one of the thermal elements is fired, it produces a dot on media 14. If thermal element 12 remains idle, no dot is formed. Thus, a dot or a blank area will result at site A depending on whether the selected thermal element is fired or not fired. Likewise, thermal elements adjacent to the selected thermal element can create adjacent dots, or leave adjacent blank areas, at sites such as $B_{left}$ and $B_{right}$. As media 14 advances, dots and blank areas that have been created in past generations (e.g., C, $D_{left}$, $D_{right}$, E in FIGS. 3 and 4) can be considered as part of a dot history pattern. Thus, in the simplest terms, as noted earlier, dot history takes into account the firing, over time, of a thermal element and/or an adjacent thermal element or elements.

Specifically with regard to FIG. 3, current burn pattern 24 is formed when the selected thermal element proximate site A and the adjacent thermal elements proximate sites $B_{left}$ and $B_{right}$ fired, or did not fire, during the current raster line. Previous burn pattern 26 is formed when the selected thermal element proximate site A fired, or did not fire, in the previous raster line, and the two-back burn pattern 28 is formed when the thermal element proximate site A fired, or did not fire, in the two-back raster line. As media 14 moves, thermal elements either fire, or do not fire, and burn patterns 24, 26, 28 are created in each raster line. Accounting for the various burn patterns 24, 26, 28 forms a dot history pattern 20.

FIG. 4 illustrates another example of a dot history pattern that can be used with the invention. Burn patterns, 24*a*, 26*a*, 28*a*, are shown for dot history pattern 20*a* of FIG. 4. Unlike dot history pattern 20 of FIG. 3, the dot history pattern 20*a* of FIG. 4 also incorporates thermal elements adjacent to the selected thermal element that fired, or did not fire, in the previous raster line, e.g. $D_{left}$, $D_{right}$.

A multitude of variations in the burn pattern configurations can be employed in the invention. Also, the number of raster lines that are labeled and monitored can be extended and/or augmented as convenient (e.g., current, previous, two-back, three-back, and so on). However, the more thermal elements and generations that are examined, the more complex dot history calculations become because more possible dot history pattern combinations exist.

As printing continues, new current, previous, and two-back raster lines are continually defined. For example, as a new raster line is printed, the current raster line assumes the position of the previous raster line, the previous raster line assumes the position of the two-back raster line, and the newly printed raster line becomes the current raster line. As new raster lines are generated, the raster lines correspondingly defined burn patterns, which continually change depending on the firing, or lack of firing, of thermal elements.

To better appreciate the benefits of utilizing dot history, an example using the dot history pattern 20 of FIG. 3 is provided. If the selected thermal element associated with site A has been energized twice consecutively, it generates two dots. Since the dots are printed consecutively, a dot will appear in the current burn pattern at site A and in the previous burn pattern at site C. As media 14 proceeds relative to the direction of printing arrow 22, the dot at site C will shift to site E, the dot at site A will shift to site C, and a new dot can be produced at site A. However, because the time period between the generation of dots is relatively short (e.g., about 6.67 milliseconds), the selected thermal element will retain heat and be hot after having produced the two consecutive dots. Thus, the amount of energy required to raise the temperature of the selected thermal element to a level sufficient to produce a new dot at site A in the current burn pattern is reduced because of the retained heat. The selected thermal element will require less energy to generate a dot, and therefore, less energy can be sent to the thermal element.

On the other end of the spectrum, a thermal element that has remained idle can also be considered. If the selected thermal element is scheduled to generate a printed dot at site A, and the selected thermal element has been idle such that no dot is found at sites C and/or E, the selected thermal element will have retained little or no heat. As a result, a greater amount of energy will be required for the selected thermal element to reach a temperature sufficient to produce a dot when compared to the instance when a selected thermal element was previously fired. In other words, the selected thermal element is cold and requires more energy to heat up to generate a dot on media 14.

Using dot history to accommodate heat, if any, retained by thermal elements (or heat radiated by adjacent thermal element neighbors, if any) permits the printing system to account for and adjust the amount of energy delivered to each thermal element. This helps prevent malformed or unaesthetic images. Also, dot history allows for the regulation of energy by accounting for many different energy levels.

Performing the dot history calculations to determine the various energy levels is a task that is typically accomplished by the processor in the printing system. If the dot history calculations, which includes performing numerous calculations regarding the specific supply characteristics, are undertaken during printing, the printing process can be slowed.

The decision to use one dot history pattern over another can be made based on numerous factors. Such factors include, but are not limited to, the supply characteristics, the processor size, the processor speed, the amount of heat being retained by a thermal element, the amount of heat radiated by adjacent neighbors, the printer speed, etc.

Referring again to the method illustrated in FIG. 2, after a desired dot history pattern 20 is selected, a thermal element number is determined. The thermal element number is defined as the sum of the number of sites where thermal elements can create, or have created, dots in the burn patterns for the dot history pattern selected, excluding site A associated with the selected thermal element in the current burn pattern. Therefore, the thermal element number for FIG. 3 is four. Four sites, namely $B_{left}$, $B_{right}$, C, and E, are included in the result to achieve the thermal element number for FIG. 3. FIG. 4 uses a different dot history pattern. The thermal element number for FIG. 4 is six because there are six sites, namely $B_{left}$, $B_{right}$, C, $D_{left}$, $D_{right}$, and E.

Figure 5:
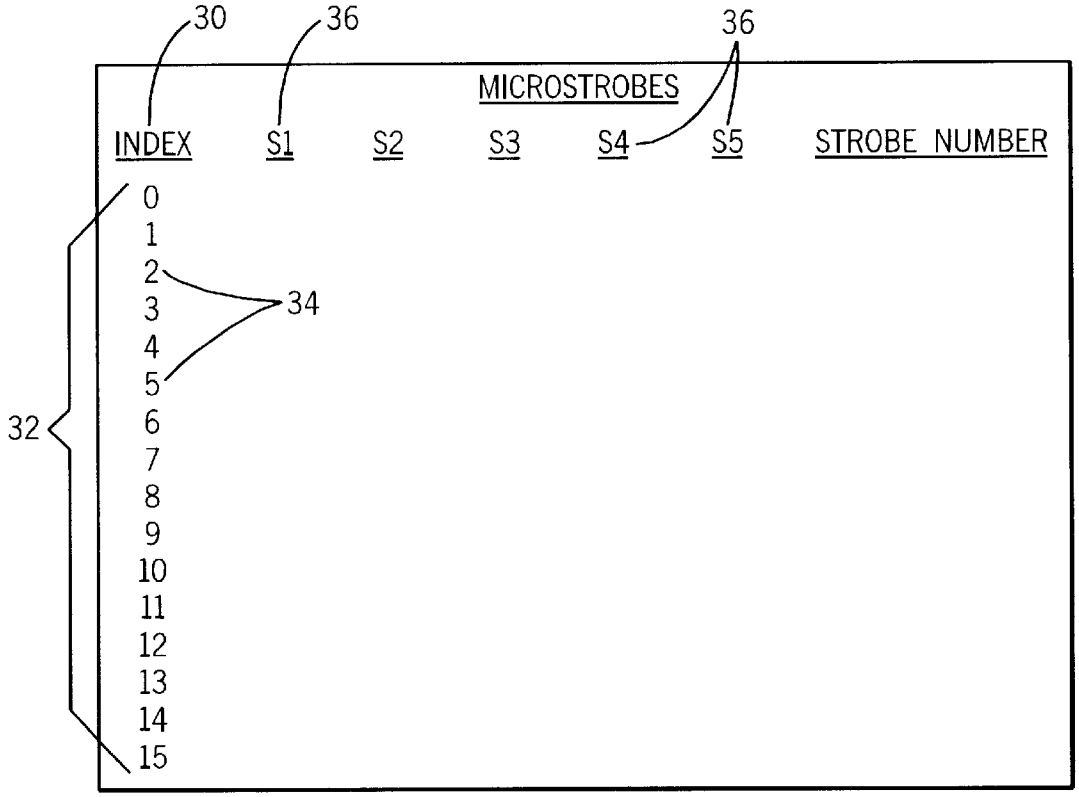
FIG. 5 illustrates, in one embodiment of the invention, a partially completed organizational table comprising index values, based on the dot history pattern of FIG. 3, occupying an index length.

After determining the thermal element number, an index 30 having an index length 32, as illustrated in FIG. 5, can be generated. In preferred embodiments, index length 32 corresponds to the number of rows used in the table of FIG. 5. Index length 32 is based, at least in part, on the thermal element number. In preferred embodiments, index length 32 is also based on whether energy is delivered to each thermal element 12 by the microcontroller. For thermal element 12 to fire and produce a dot, a sufficient amount of energy is delivered. For thermal element 12 to remain idle, and thus not produce a dot, no energy or an insufficient level of energy is delivered. As such, there are two possible energy combinations for each thermal element 12 (i.e., either the thermal element receives energy or it does not). Having determined the thermal element number, index length 32 can be calculated based on the thermal element number and the number of possible energy value combinations (e.g., two (2) for a thermal element). In a preferred embodiment of the invention, index length 32 is calculated using the formula:

$$\text{Index length} = (\text{number of possible energy value combinations})^{\text{thermal element number}}$$

In this preferred embodiment, index length 32 is the number of possible energy value combinations raised to the thermal element number power.

Using the dot history pattern of FIG. 3 as an example, there are again two possible energy value combinations. Also, the thermal element number is four. Inserting those values into the formula of the preferred embodiment (see above) yields an index length of $2^4$, or sixteen. As illustrated in FIG. 5, index length 32 depicted correspondingly has sixteen values (represented by the numbers 0 to 15 in index 30).

As a further example, if the same index length formula is applied to the dot history pattern of FIG. 4, the formula yields an index length of $2^6$, or sixty-four. Thus, it is worthwhile to note that the more thermal elements accounted for using dot history, the larger the index will be.

After index length 32 is established, index values 34 can be generated to occupy the index 30 over the entire index length 32. Index values 34 are based on the selected dot history pattern 20. As the names suggest, index 30 and index values 34 can be used to arrange and assemble corresponding pieces of data in an organized manner. In preferred embodiments, index values 34 can represent one or more of the possible combinations of intermittently fired thermal elements 12.

Since an index length 32 of sixteen was produced using the dot history pattern 20 of FIG. 3, index values 34 can correspondingly be determined. While index values can be generated in a variety of ways, in one preferred embodiment, the index values are calculated by assigning binary numbers (e.g., a 1 or a 0) to each site in the burn patterns 24, 26, 28. Thereafter, in preferred embodiments, the binary numbers for the sites proximate thermal elements are inserting into the following formula:

$$\text{Index value}=B_{left}+(2\times B_{right})+(4\times C)+(8\times E)$$

If a thermal element has been fired to generate a dot at one or more of sites $B_{left}$, $B_{right}$, C, and/or E, a 1 is inserted into the formula for those sites. In other words, a 1 represents that the thermal element is ON and the thermal element receives energy. If, however, a thermal element has not been fired and no dot is generated at one or more of the sites, a 0 is inserted into the formula for those sites. In other words, a 0 represents that the thermal element is OFF and the thermal element does not receive energy or received an insufficient level of energy. Using the index value formula above, and inserting the binary numbers based on the combinations of thermal element firing in the dot history pattern, a series of consecutive numbers from 0 to 15 can be generated for the dot history pattern 20 of FIG. 3. These index values 34 are arranged in sequential order, from smallest to largest, as illustrated in FIG. 5. Should a different dot history pattern be selected, the index value formula can be modified to account for other thermal elements (e.g., $D_{left}$ and $D_{right}$) as illustrated in FIG. 4.

Once the index values 34 have been determined as illustrated in FIG. 5, a microstrobe number representing microstrobes 36 can be selected. Microstrobes 36 comprise a pulse of energy delivered to a thermal element by a microcontroller during a print interval. A print interval is defined as the time spent printing one raster line. The microstrobe number comprises the number of microstrobes 36 that will be utilized in the invention (i.e., the number of pulses a thermal element shall be provided for preheating and/or dot-generating purposes). The microstrobe number can be selected as convenient while considering the specific supply characteristics such as ribbon thickness, ink melting point, and the like. Microstrobes 36 are typically separated by a short amount of time (e.g., about 200 hundred microseconds) while a print interval comprises a longer amount of time (e.g., about 6.67 milliseconds).

In preferred embodiments, the microstrobe number selected is between two and eight. In one preferred embodiment, as illustrated in FIG. 5, a microstrobe number of five is selected. As shown in FIG. 5, the microstrobes 36 are labeled S1, S2, S3, S4, and S5 and are arranged within the table.

Figure 6:
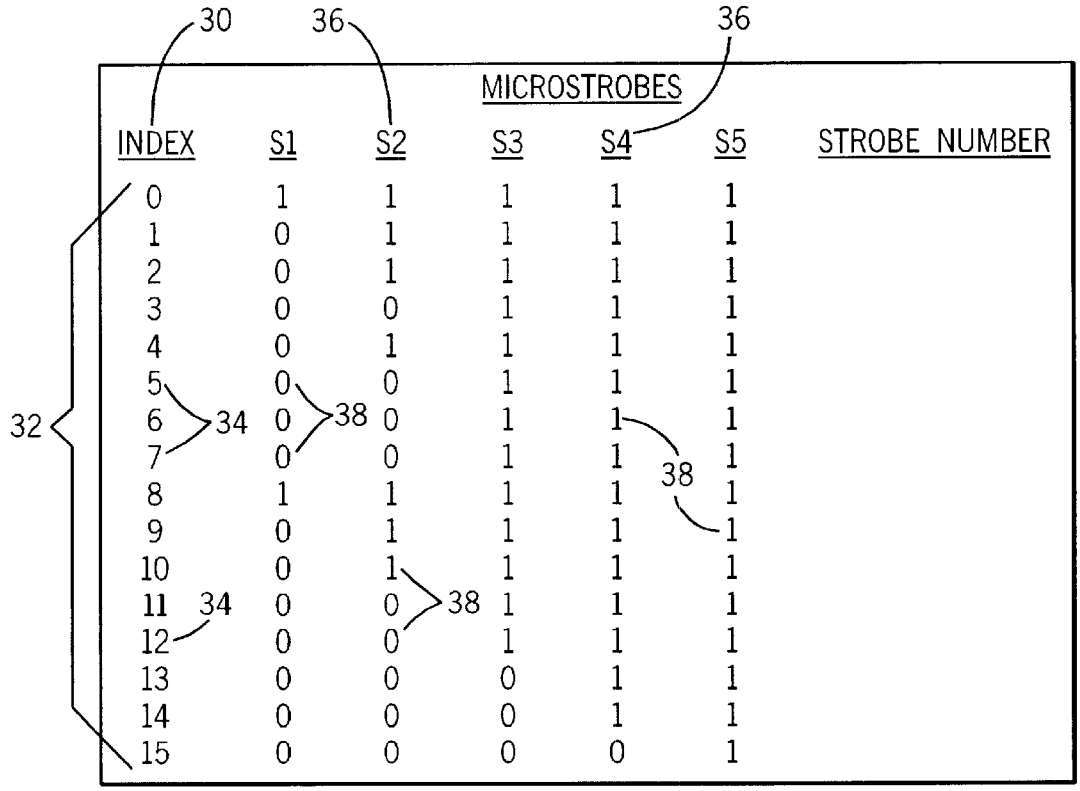
FIG. 6 illustrates, in one embodiment of the invention, a partially completed organizational table of FIG. 5 further comprising binary pulse numbers assigned to microstrobes.

Once the microstrobe number is determined, binary pulse numbers 38, as illustrated in FIG. 6, are assigned to the various microstrobes 36. If a 1 is assigned to a microstrobe, then a pulse of energy is delivered to a thermal element at that time. In other words, a 1 represents that the microstrobe is ON and the microstrobe receives energy. If a 0 is assigned to a microstrobe, then no pulse of energy is delivered to the thermal element at that time. In other words, a 0 represents that the thermal element is OFF and the microstrobe does not receive energy. Even though a microstrobe may be assigned a 1, and a pulse of energy delivered, a dot is not necessarily generated. Unlike the binary numbers earlier assigned to the thermal elements, the binary pulse numbers 38 assigned to the microstrobes 36 only indicate delivery of energy, and not a printed dot. Despite energy being delivered during a microstrobe 36, the energy can be sufficient for preheating while remaining insufficient to generate a dot. Whether a thermal element is preheated, or generates a dot, depends upon the temperature that the thermal element reaches upon receipt of the energy.

To make the determination of whether to assign a 1 or a 0 to a particular microstrobe 36, a suitable microstrobe pattern is selected. The microstrobe pattern is defined as the order in which microstrobes 36 are fired. To determine the microstrobe pattern, the microstrobe 36 that actually causes thermal elements 12 to produce dots, as well as which of the microstrobes are used for preheating thermal elements, is taken into account.

Figure 7:
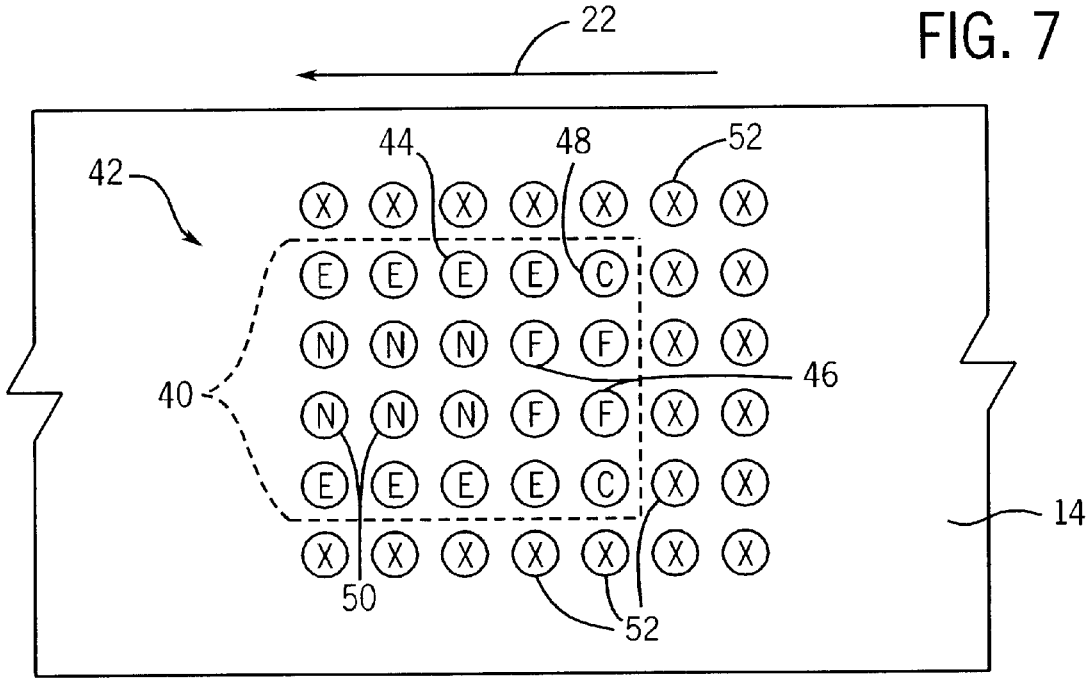
FIG. 7 illustrates an example of an image to be printed on the media using the printing process of FIG. 1.

The microstrobe pattern can be determined, at least in part, by considering how an image to be printed 40, an example of which is illustrated in FIG. 7, at a particular location on the media 14 will be formed. In FIG. 7, an example of an image to be printed 40 (e.g., a rectangular object) is represented within a group of dots 42. As shown, the image to be printed 40 comprises an edge dot 44, a leading edge dot 46, a leading corner dot 48, and an interior dot 50. Also depicted in FIG. 7 are several unprinted sites 52, where no dot is produced around image to be printed 40. Based on the selected microstrobe pattern and the image to be printed 40, binary pulse numbers 38 are assigned to each of the microstrobes 36 for each index value 34, until the index length 32 in FIG. 6 is fully occupied.

In one preferred embodiment, the strobe pattern comprises the situation where the S5 microstrobe 36 is the microstrobe that generates dots. Therefore, the S5 microstrobe 36 is always assigned a 1 , regardless of the corresponding index value 34. Thereafter, each of the microstrobes 36, namely S1–4, is used for the purpose of preheating a thermal element 12. In this embodiment, the S4 microstrobe 36 is assigned a 1 if there are any adjacent pins that did not generate a burn. As such, the S4 microstrobe 36 is generally the microstrobe associated with edge dots 44 and not used inside an object to be printed 40 which comprises solid dots. The S3 microstrobe 36 is the microstrobe that is associated with leading edges 46 of an object to be printed 40. Continuing, the S2 microstrobe 36 is the microstrobe that is associated with leading corners. As such, the S2 microstrobe 36 generally receives energy if less than two adjacent thermal elements received energy, but with some exceptions. For example, referring to FIG. 3, an exception is made when the two adjacent thermal elements comprise the thermal element associated with site E and the thermal element associated with either $B_{left}$ or $B_{right}$. The exception is employed because the thermal element associated with site E, in the two-back raster line, contributes only a small amount of heat to the selected thermal element associated with site A. And finally, the S1 microstrobe 36 is the microstrobe that is associated with a selected thermal element when neither of the thermal elements associated with sites $B_{left}$, $B_{right}$, or C receives energy. With the S1 microstrobe 36, the thermal element associated with E is usually disregarded and, therefore, the index values 34 associated with 0 and 8 will permit the S1 microstrobe to receive energy. In many embodiments, a suitable strobe pattern, as determined above, can be used with a wide variety of supplies.

In another preferred embodiment, the microstrobe labeled S1 is chronologically the first microstrobe that is provided a pulse of energy by the microcontroller. Thereafter, microstrobes S2, S3, and S4 sequentially receive pulses of energy to keep a thermal element preheated and/or generate a dot. Again, the microstrobe labeled S5 is the microstrobe that causes a thermal element to become sufficiently heated to generate a dot at a site.

In preferred embodiments, where microstrobe S5 is the microstrobe that generates the dots, microstrobe S5 delivers the largest pulse of energy when compared to the other microstrobes. It is not required that the last microstrobe in the series of microstrobes be the one that generates the dots, nor is it required that five microstrobes be selected.

Using the binary pulse numbers 38 (i.e., the ones and zeros assigned to the microstrobes 36), and knowing the microstrobe number, microstrobe energy values 54 are determined for each microstrobe 36 as illustrated in FIG. 8. Microstrobe energy values 54 represent the amount of energy (in watts) in each microstrobe pulse supplied to a thermal element at a given time to assist in keeping that thermal element preheated and/or generate a dot. The microstrobe energy routed to each thermal element during printing is determined based on the specific supply being used for printing. For example, if a chosen supply requires thermal elements to be exceptionally hot to generate a dot, the microstrobe energies might be accordingly set exceptionally high to keep the temperature of the thermal element high.

To determine appropriate microstrobe energy values 54, testing is often conducted for each specific supply. Typically, testing involves a trial and error method of assigning microstrobe energy values 54. For example, initial microstrobe energy values 54 are assigned to microstrobes 36, and the microstrobes are fired to produce one or more raster lines. If, during the test firing, too much ink is transferred from the ribbon to the media, one or more of the initial microstrobe energy values 54 for one or more of the microstrobes 36 can be reduced. Conversely, if during the test firing too little ink is transferred from the ribbon to the media, one or more of the initial microstrobe energy values 54 for one or more of the microstrobes 36 can be increased. Whether too much or too little ink is transferred to the media during firing can be a subjective, aesthetically-motivated determination based on whether a dot provides sufficient coverage of ink on the site where the dot was produced. By completing one, and often several, iterations of the trial and error method for a specific supply, microstrobe energy values 54 can be ascertained.

After binary pulse numbers 38 have been determined, a strobe number 56 can be calculated. Strobe number 56 represents a combination of microstrobes 36 (each of which corresponds to a microstrobe energy value 54 from FIG. 8) used to keep a thermal element preheated and/or generate printed dots. Each strobe number 56 generally corresponds to an index value 34 in the index 30 as illustrated in FIG. 9. In a preferred embodiment, a strobe number 56 corresponding to each index value 34 is calculated by inserting the assigned binary pulse numbers 38 for each of the microstrobes 36 into the following formula:

$$\text{Strobe number}=S1+(2\times S2)+(4\times S3)+(8\times S4)+(16\times S5)$$

For example, the strobe number 56 for the index value of 3 in FIG. 9 is calculated by inserting binary pulse numbers 38 into the above formula. Since S1 and S2 are zeros and S3, S4, and S5 are ones in FIG.9, strobe number 56 for the index value of 3 is 28 $(0+(2\times0)+(4\times1)+(8\times1)+(16\times1))$. For each index value in FIG. 9, a strobe number 56 is calculated and arranged using the binary pulse numbers 38 assigned to microstrobes 36.

At the point where the table in FIG. 9 has been assembled, a microstrobe number has been selected as illustrated in FIG. 5, microstrobe energy values 54 have been determined as illustrated in FIG. 8, and a strobe number has been determined as illustrated in FIG. 9. Therefore, the next step in the method comprises storing the microstrobe number, the microstrobe energy values 54, and the strobe numbers 56 in a memory associated with the specific supply for which these printing parameters were calculated. By storing these printing parameters in the memory, they can quickly, easily, and efficiently be accessed by a processor in a thermal printing system when, for example, a supply container (e.g., a cartridge), bearing the supply is loaded into the printing system.

Typically, printers known in the art require a processor to make all, or almost all, of the energy value calculations for thermal elements while the printer is printing. In contrast, using the present invention, a look-up table of printing parameters comprising a microstrobe number, microstrobe energy values, and strobe numbers can be generated and provide pre-calculated printing parameters for each specific supply. Thus, when printing is to be performed, the processor in the printing system using the invention need not perform many of the calculations during printing. The calculations, corresponding to each new supply, have already been determined and stored in the memory associated with the supply. A printer can access the printing parameters, store that information in a random access memory within the printer, and permit the processor within the printer to use that stored information for printing. As such, the workload of the processor, during printing, is reduced.

In one embodiment, the memory comprises a solid-state memory device, a RAM (random-access memory), a non-volatile RAM, an EEPROM (electrically erasable programmable read-only memory), or a flash memory. Also, in another embodiment, the memory can comprise a memory cell located proximate the supply by being secured to the outside of a supply container, to the inside of the supply container, or otherwise.

In one embodiment, the memory cell can be erased after the supply stored within the supply container is exhausted. In another embodiment, the memory cell can contain an electronic lock capable of being unlocking by an electronic key associated with the printer. The electronic key can be accessed by the printer and permit the printer to unlock the supply specific printing parameters stored in the memory cell.

In a printing system using one embodiment of the invention, a cartridge with a specific supply is loaded into the printer. The processor in the printing system accesses the supply parameters on the memory cell and printing instructions are generated. The processor then sends the printing instructions, or portions thereof, to the microcontroller. The microcontroller is that device which provides the thermal elements with the pulses of energy known as microstrobes. The microcontroller accepts the printing instructions from the processor and orchestrates delivery of energy during microstrobes resulting in the subsequent firing of the thermal elements disposed on the printhead to create a printed image.

The printing system can further comprise a keyboard, a monitor, and a mouse for accessing, inputting, and displaying information used in the printing system. Further, the supply cartridge in the system can be ergonomically designed to compliment the hand of an operator of the printing system.

While the invention herein is generally directed to a thermal printing process, embodiments of the present invention can include, but are not limited to, a thermal wax transfer process, a thermal dye diffusion process, or a direct thermal transfer process. In the direct thermal transfer embodiment, no ribbon, or accompanying ribbon delivery and take up roller, is used. The thermal printhead presses directly against a thermally reactive media while the platen rotates to drive the media past the thermal printhead. Also, embodiments of the invention can include, but are not limited to, other types of printing, including non-thermal printing.

Despite the above method being outlined in a step-by-step sequence, the completion of the acts or steps in a particular chronological order is not mandatory. Further, elimination, modification, rearrangement, combination, reordering, or the like, of the acts or steps is contemplated and considered within the scope of the description and claims.

While the present invention has been described in terms of the preferred embodiment, it is recognized that equivalents, alternatives, and modifications, aside from those expressly stated, are possible and within the scope of the appending claims.

What is claimed is:

1. A method of determining supply parameters and storing the supply parameters in a memory comprising the steps of:

providing supply characteristics for a supply;

selecting a dot history pattern;

generating a table, the table comprising values based on the selected dot history pattern and the provided supply characteristics; and storing supply parameters based on the values in the generated table in a memory associated with the supply.

2. The method of claim 1, wherein the supply characteristics are one or more characteristics selected from the group consisting of supply width, supply length, supply thickness, and ink color.

3. The method of claim 1, wherein the supply characteristics are garnered from a thermally sensitive, ink-bearing ribbon within a supply cartridge.

4. The method of claim 1, wherein the dot history pattern comprises at least one site associated with a thermal element adjacent to a selected thermal element.

5. The method of claim 1, wherein the dot history pattern comprises at least one site based on a prior generation of a selected thermal element.

6. The method of claim 1, wherein the dot history pattern comprises at least one site based on a prior generation of a thermal element adjacent to a selected thermal element.

7. The method of claim 1, wherein generation of the table is at least partially based on a thermal element number.

8. The method of claim 1, wherein generation of the table is at least partially based on a number of possible energy value combinations.

9. The method of claim 1, wherein the table further comprises index values comprising a sum of a left adjacent thermal element, a first product of two and a right adjacent thermal element, a second product of four and a previous generation of a selected thermal element, and a third product of eight and a two-back generation of the selected thermal element, wherein each of the thermal elements is represented by binary numbers.

10. The method of claim 9, wherein the index values are arranged sequentially from smallest to largest within the index.

11. The method of claim 1, wherein the table further comprises a microstrobe number determined by testing for a specific supply.

12. The method of claim 11, wherein the microstrobe number comprises one or more microstrobes, the one or more microstrobes receiving a pulse of energy about two hundred microseconds apart in a print interval.

13. The method of claim 1, wherein the table further comprises binary pulse numbers comprising a one, which corresponds to a microstrobe receiving a pulse of energy, or a zero, which corresponds to the microstrobe not receiving the pulse of energy.

14. The method of claim 13, wherein the pulse of energy received by at least one of the microstrobes is sufficient to generate a dot.

15. The method of claim 14, wherein the pulse of energy generating the dot is delivered to the at least one of the microstrobes that occurs last in a print interval.

16. The method of claim 15, wherein the binary pulse numbers for the at least one of the microstrobes that occurs last in the print interval are all ones.

17. The method of claim 1, wherein the table further comprises a strobe number.

18. The method of claim 1, wherein the memory comprises a memory cell secured to a cartridge containing the supply.

19. The method of claim 1, wherein the memory is selected from one of the group consisting of a solid-state memory device, a RAM, a non-volatile RAM, an EEPROM, and a flash memory.

20. A method of determining printing parameters and storing the printing parameters in a memory comprising the steps of:

providing supply characteristics for a supply;

selecting a dot history pattern and determining a thermal element number;

creating an index having an index length, the index length being based on the thermal element number, and determining index values to occupy the index length, the index values being based on the dot history pattern;

selecting a microstrobe number based on the supply characteristics, the microstrobe number representing microstrobes within a print interval;

assigning binary pulse numbers to the each of the microstrobes based on a strobe pattern, the binary pulse numbers corresponding to each of the index values occupying the index length;

determining, for each of the microstrobes, a microstrobe energy value based on the supply characteristics;

determining a strobe number based on the binary pulse numbers, the strobe numbers corresponding to each of the index values occupying the index length; and storing the supply parameters comprising the microstrobe number, the microstrobe energy values, and the strobe numbers in the memory associated with the supply.

21. The method of claim 20, wherein the thermal element number comprises a sum of sites associated with thermal elements adjacent to a selected thermal element, sites that are prior generations of the selected thermal element, and sites that are prior generations of the thermal elements adjacent to the selected thermal element.

22. The method of claim 20, wherein the index length comprises possible energy value combinations raised to the thermal element number power.

23. The method of claim 20, wherein the index values comprise a sum of a left adjacent thermal element, a first product of two and a right adjacent element, a second product of four and a previous generation of a selected thermal element, and a third product of eight and a two-back generation of the selected thermal element, wherein each of the thermal elements is represented by a binary number.

24. The method of claim 20, wherein the strobe number comprises a sum of a first binary pulse number, a first product of two and a second binary pulse number, a second product of four and a third binary pulse number, a third product of eight and a fourth binary pulse number, and a fourth product of sixteen and a fifth binary pulse number.

25. The method of claim 20, wherein the strobe pattern is one in which the last microstrobe in the print interval generates dots.

26. A method of increasing efficiency of a processor in a thermal printing system using supply parameters stored in a memory comprising the steps of:

providing supply characteristics for a supply;

selecting a dot history pattern and determining a thermal element number;

creating an index having an index length, the index length being based on the thermal element number, and determining index values to occupy the index length, the index values being based on the dot history pattern;

selecting a microstrobe number based on the supply characteristics, the microstrobe number representing microstrobes within a print interval;

assigning binary pulse numbers to the each of the microstrobes based on a strobe pattern, the binary pulse numbers corresponding to each of the index values occupying the index length;

determining, for each of the microstrobes, a microstrobe energy value based on the supply characteristics;

determining a strobe number based on the binary pulse numbers, the strobe numbers corresponding to each of the index values occupying the index length;

storing the supply parameters comprising the microstrobe number, the microstrobe energy values, and the strobe numbers in the memory associated with the supply; and accessing the supply parameters using the processor.

27. The method of claim 26, the method further comprising employing the accessed supply parameters to increase printing speed.

28. The method of claim 26, the method further comprising regulating energy provided to thermal elements with the accessed supply parameters.

29. The method of claim 28, wherein the energy provided to thermal elements is regulated such that dots that are generated are not selected from the group of malformed, fractional, unaesthetic, and undesirably generated.

30. A printing system for thermal printing comprising:

a printhead, the printhead comprising thermal elements for generating dots;

a processor for processing supply parameters;

a microcontroller for receiving signals from the processor and orchestrating the thermal elements in the printhead such that an image of dots can be generated; and a supply cartridge comprising a thermally sensitive supply and a memory, the supply cartridge being inserted within the printing system;

wherein supply characteristics are provided for a supply, a dot history pattern is selected, a table is generated, the table comprising values based on the selected dot history pattern and the provided supply characteristics, and supply parameters, based on the values in the generated table, are stored in a memory associated with the supply.

31. The system of claim 30, wherein the system further comprises one or more system accessories selected from the group of a keyboard, a monitor, and a mouse.

32. The system of claim 30, wherein the supply cartridge is ergonomically designed to compliment a hand of a printer system operator.

33. The system of claim 30, wherein the supply parameters are accessed to increase printing speed.

34. The system of claim 30, wherein energy provided to thermal elements is regulated using the accessed supply parameters.

35. An apparatus for use in a printer, the apparatus comprising:

a supply container;

a memory cell associated with the supply container; and supply specific printing parameters stored within the memory cell;

wherein the printer is configured to receive the supply container and a processor associated with the printer can obtain access to the supply specific printing parameters when the supply container is received.

36. The apparatus of claim 35, wherein the printer is a thermal printer.

37. The apparatus of claim 35, wherein the supply specific parameters are loaded into a random access memory within the printer when the supply container is received.

38. The apparatus of claim 37, wherein the processor associated with the printer obtains the supply specific parameters from the random access memory.

39. The apparatus of claim 35, wherein the memory cell is erased after a supply stored within the supply container is exhausted.

40. The apparatus of claim 35, wherein the memory cell contains an electronic lock capable of being unlocked by an electronic key associated with the printer.

41. The apparatus of claim 40, wherein the electronic key is accessed by the printer and used to unlock the supply specific printing parameters stored in the memory cell.

* * * * *